US005384429A

United States Patent [19]

Bulson et al.

[11] Patent Number: 5,384,429

[45] Date of Patent: Jan. 24, 1995

[54] LOW IMPEDANCE SURGE PROTECTIVE DEVICE CABLES FOR POWER LINE USAGE

[75] Inventors: Jeffry M. Bulson, Owego; C. Peter Rau, Apalachin, both of N.Y.

[73] Assignee: Emerson Electric Co., St. Louis, Mo.

[21] Appl. No.: 80,507

[22] Filed: Jun. 24, 1993

[51] Int. Cl.[6] ..... H01B 11/18

[52] U.S. Cl. ..... 174/102 R; 174/36; 174/107; 361/107; 361/113; 361/127

[58] Field of Search ..... 174/102 R, 36, 107, 174/109; 361/107, 113, 127

[56] References Cited

U.S. PATENT DOCUMENTS

| | | | |
|---|---|---|---|
| 2,066,201 | 12/1936 | Jack | 174/102 R |
| 2,298,428 | 10/1942 | Smith | 174/102 R |
| 2,754,350 | 7/1956 | Hurd | 174/102 R |
| 3,259,857 | 7/1966 | Garstang | 174/102 R |
| 3,493,815 | 2/1970 | Hurtle . | |
| 4,539,617 | 9/1985 | Delaney et al. | 361/113 |
| 4,912,589 | 3/1990 | Stolarczyk | 361/127 X |
| 4,987,274 | 1/1991 | Miller et al. | 174/102 R |
| 5,053,910 | 10/1991 | Goldstein | 361/113 X |
| 5,146,048 | 9/1992 | Yutori et al. | 174/36 |
| 5,218,507 | 6/1993 | Ashley | 361/107 |

*Primary Examiner*—Morris H. Nimmo

*Attorney, Agent, or Firm*—Polster, Lieder, Woodruff & Lucchesi

[57] ABSTRACT

A coaxial cable (10) is for use in a power distribution network (N). The cable connects a surge protective device (SPD) in parallel with feeder lines (W1, W2) of the network. The SPD senses voltage surges on the feeder lines and clamps the voltages to a level at which loads (LD) connected downstream of the SPD are protected from excessive voltage levels. An inner conductor (12) and an outer conductor (14) have a dielectric material (16) separating them. The inner conductor is a round conductor, and the outer conductor forms a hollow cylinder in which the inner conductor and insulation material fit. A ratio of the inner diameter (D) of the outer conductor to the diameter (d) of the inner conductor is approximately 1.05. Thus, the diameter of the inner conductor is relatively large compared with the inner diameter of the outer conductor. A relatively large diameter of the inner conductor serves to minimize the dc resistance of the cable. Also, the dielectric material has a permittivity in the range of 2.0–4.0. Performance characteristics of the coaxial cable are compared with those of other conductors to illustrate the superiority of the coaxial cable in reducing "let through" voltage otherwise passed by a surge protector device to the loads.

16 Claims, 3 Drawing Sheets

| Type | Geometry | $\mathcal{L}=L/\ell$ | $\mathcal{R}=R/\ell$ | $\mathcal{C}=C/\ell$ | real($Z_c$) |
|---|---|---|---|---|---|
| Coaxial | 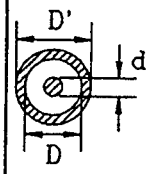  | $\frac{\mu_o}{2\pi}\ln(\frac{D}{d})$ | $\frac{\rho}{\frac{\pi}{4}(D'-D+d)}$ | $\frac{2\pi\epsilon_o\epsilon}{\ln(\frac{D}{d})}$ | $\approx\frac{Z_o}{2\pi\sqrt{\epsilon}}\ln(\frac{D}{d})$ |
| Twin (r<<w) | 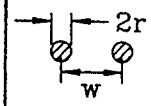  | $\frac{\mu_o}{\pi}\ln(\frac{w}{r})$ | $\frac{\rho}{2\pi r^2}$ | $\frac{\pi\epsilon_o\epsilon}{\ln(\frac{w}{r})}$ | $\approx\frac{Z_o}{\pi\sqrt{\epsilon}}\ln(\frac{w}{r})$ |
| Shielded Twin (r<<w) | 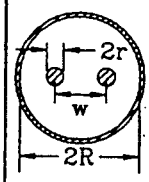  | $\frac{\mu_o}{\pi}\ln(\frac{w}{r}\gamma)$ | $\frac{\rho}{2\pi r^2}$ | $\frac{\pi\epsilon_o\epsilon}{\ln(\frac{w}{r}\gamma)}$ | $\approx\frac{Z_o}{\pi\sqrt{\epsilon}}\ln(\frac{w}{r}\gamma)$ |
| Parallel Plate | 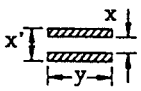  | $\mu_o(\frac{x}{y})$ | $\frac{\rho}{y(x'-x)}$ | $\epsilon_o\epsilon(\frac{y}{x})$ | $\approx\frac{Z_o}{\sqrt{\epsilon}}(\frac{x}{y})$ |

$$Z_o \equiv \sqrt{\frac{\mu_o}{\epsilon_o}} \approx 120\pi \ \Omega$$

$$\gamma \equiv \frac{1-(\frac{w}{2R})^2}{1+(\frac{w}{2R})^2}$$

$\mu_o \equiv$ vacuum permeability $= 4\pi\cdot 10^{-7}$ H/m $\epsilon_o \equiv$ vacuum permittivity $= 8.8542\cdot 10^{-12}$ F/m $\epsilon \equiv$ dielectric relative permittivity $\rho \equiv$ conductor resistivity

FIG.3.

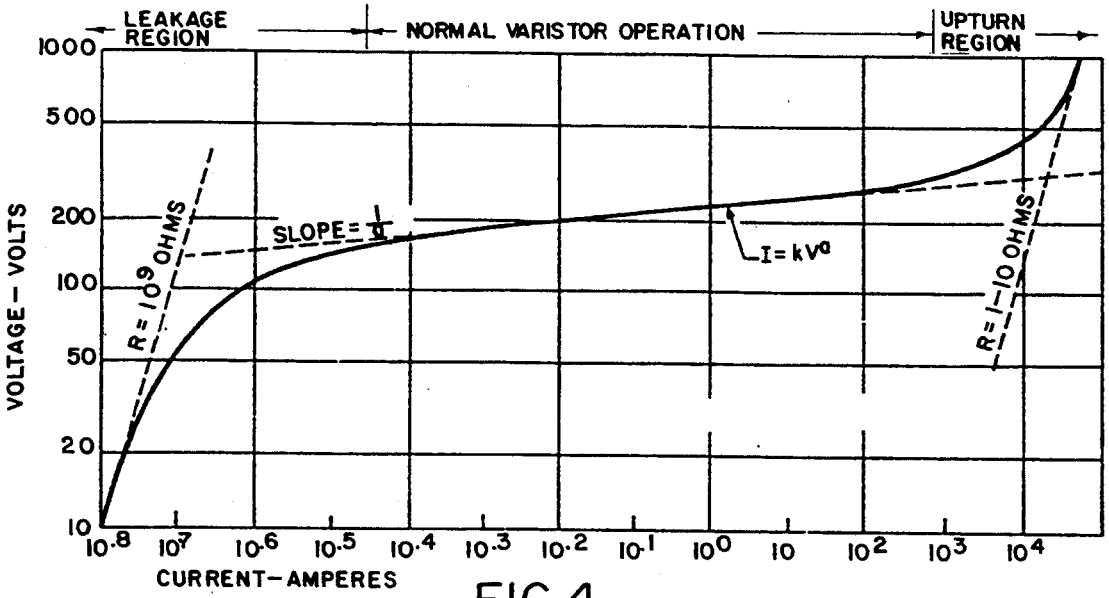

FIG.4.

| No. | Parameter | #14 AWG | #10 AWG | #6 AWG | #2 AWG | #3/0 AWG | MOV #1 | MOV #2 |
|---|---|---|---|---|---|---|---|---|
| 1 | D (in.) | 0.100 | 0.126 | 0.190 | 0.285 | 0.475 | | |
| 2 | d (in.) | 0.064 | 0.101 | 0.162 | 0.260 | 0.450 | | |
| 3 | $\delta/r+1$ | 1.562 | 1.248 | 1.173 | 1.096 | 1.055 | | |
| 4 | $\mathcal{L}$ (nH/m) | 89.3 | 44.2 | 31.9 | 18.4 | 10.8 | | |
| 5 | L (nH) | 178.5 | 88.4 | 63.8 | 36.7 | 21.6 | | |
| 6 | $\mathbf{C}$ (pF/m) | 374 | 754 | 1045 | 1815 | 3083 | | |
| 7 | C (pF) | 747 | 1507 | 2091 | 3631 | 6165 | | |
| 8 | real($Z_c$) ($\Omega$) | 15.5 | 7.66 | 5.52 | 3.18 | 1.87 | | |
| 9 | $r_{braid}$ (m$\Omega$) | 16.4 | 16.8 | 10.2 | 9.2 | 8.3 | | |
| 10 | $r_{cc}$ (m$\Omega$) | 16.7 | 6.46 | 4.13 | 1.78 | 0.66 | | |
| 11 | $r_T$ (m$\Omega$) | 33.1 | 23.3 | 14.3 | 11.0 | 8.93 | | |
| 12 | $V_c$ (V) | 891 | 864 | 868 | 863 | 855 | 842 | 834 |
| 13 | $\sigma_v$ (V) | 3.9 | 3.0 | 3.3 | 3.0 | 2.3 | 2.4 | 3.5 |
| 14 | $I_c$ (A) | 975 | 932 | 1021 | 1014 | 1043 | 1108 | 998 |
| 15 | $\sigma_I$ (A) | 17.8 | 11.9 | 20.9 | 29.5 | 19.4 | 6.1 | 20.9 |
| 16 | $\Delta V$ (V) | 49.2 | 30.4 | 26.4 | 21.2 | 13.2 | 0 | 0 |
| 17 | $V_r$ (V) | 32.3 | 21.7 | 14.6 | 11.1 | 9.3 | | |
| 18 | $V_L$ (V) | 21.8 | 10.3 | 8.1 | 4.7 | 2.8 | | |
| 19 | $V_T$ (V) | 54.0 | 32.0 | 22.7 | 15.8 | 12.1 | | |

LOW IMPEDANCE SURGE PROTECTIVE DEVICE CABLES FOR POWER LINE USAGE

BACKGROUND OF THE INVENTION

This invention relates to surge protective devices (SPD's) and, more particularly, to a low impedance, or low-Z cable for use to connect SPD's in power line applications.

A surge protective device, or SPD, is used in power distribution network applications to protect loads connected to the network from high voltage surges or transients. Examples of the types of installation in which SPD's are used include centrifugal fire pumps, HVAC systems, computerized numerical control (CNC) machines, PLC's, and uninterruptible power supplies (UPS) for computer systems. SPD's use a variety of protection technologies. These include zener and selenium diodes, metal-oxide and silicon carbide varistors, and crowbar devices such as triggered and untriggered spark gaps.

In use, a SPD is connected across two feeder lines of the power distribution network. In a three-phase distribution system this would be one of the phase lines, and neutral; or, between phases, phases-to-ground and neutral-to-ground. An SPD can be connected on either the service side or load side of a service distribution buss. It can also be located on branch service busses and at distribution panels. Often, SPD units consist of a collection of SPD modules parallel wired to terminal blocks, as well as to disconnects inside a unit. When a voltage surge propagates down the conductor lines, it is sensed by the SPD. If the surge voltage exceeds the threshold level of the SPD, the SPD then presents a short-circuit across the conductors until the surge level falls back below the threshold. The downstream loads, especially those of relatively high impedance, are thus protected from the surge voltage.

It will be appreciated that in an ideal network, the SPD would present a perfect short-circuit in front of the loads, and would divert all of the current back to the source. However, because most configurations are less than ideal, the SPD is not necessarily exposed to all of the transient voltage. This is because while power distribution systems are designed to efficiently transmit 60 Hz power, they are not designed to transmit fast transient surges; i.e., voltage spikes of about 10 microsecond ($10^{-6}$ sec.) or faster rise time. Consequently, some of the surge voltage is "let through" to the loads. Subjecting the loads to these high voltage transients is harmful to them. One culprit in this regard is the wiring or cabling used to connect the SPD in parallel with the network conductors. Conventionally, this cable is a shielded twin conductor cable. Shielded twin cables include two parallel conductors of radius r embedded in an insulator material with a distance w between the longitudinal axis of the conductors. A shield (typically conduit) encloses the conductors and insulator. The transient voltage drop across the wiring used in these shielded twin cable applications is sufficiently high that the SPD is not exposed to the full amplitude of a voltage surge. Accordingly, either the SPD is not switched into operation; or if it is, switching occurs at a higher transient voltage level than that to which the device is ultimately designed. Having available a lower impedance cable specifically for use in these configurations would allow the SPD's to be more effective in protecting downstream loads from exposure to excessively high voltages.

SUMMARY OF THE INVENTION

Among the several objects of the present invention may be noted the provision of a cable for use in power distribution applications for connecting SPD's in parallel with power distribution network conductors, so the SPD's can protect loads connected to the network from high voltage surges or transients; the provision of such a cable which is a low impedance, or low-Z cable so the voltage drop across the cable is minimal, minimal voltage drop insuring the SPD is subjected to substantially all the transient voltage; the provision of such a low impedance cable whose use limits the amount of voltage "let through" to which loads downstream of the SPD are subjected; the provision of such a cable whose low impedance is based upon optimizing cable geometry, cable dimensions, and the materials from which the cable is fabricated; the provision of such a low impedance cable having a minimized series inductance and DC resistance so to have a minimum impedance at the frequencies at which surges or transients occur; the provision of such a low impedance cable comprising parallel conductors separated by an insulator providing a negligible shunt conductance between the conductors; the provision of such a low impedance cable to be a coaxial cable having a compact form and aspect ratio slightly greater than 1.0; the provision of such a low impedance cable which allows a greatly improved SPD clamping voltage rating; the provision of such a cable which is usable to connect any type SPD in parallel with the conductors; and, the provision of such a cable which is easy to make, readily connected in a power distribution network, and safe in use.

In accordance with the invention, generally stated, a coaxial cable is for use in a power distribution network. The cable connects a SPD in parallel with feeder lines of the network. The SPD senses voltage surges on the feeder lines and clamps the voltages to a level at which loads connected downstream of the SPD are protected from excessive voltage levels. An inner conductor and an outer conductor of the cable have a dielectric material separating them. The inner conductor has a circular cross-section, and the outer conductor forms a hollow cylinder in which the inner conductor and insulation material fit. A ratio of the inner diameter of the outer conductor to the diameter of the inner conductor is approximately 1.05–1.56. Thus, the diameter of the inner conductor is nearly as large as the inner diameter of the outer conductor. A relatively large diameter of the inner conductor serves to minimize both the dc resistance and inductance of the cable. Finally, the dielectric material has a permittivity in the range of 2.0–4.0. Other objects and features will be in part apparent and in part pointed out hereinafter.

BRIEF DESCRIPTION OF THE DRAWINGS

FIG. 3 is a table of transmission line parameters for common cable geometries;

FIG. 4 is a graph of a characteristic V–I curve for a MOV;

Corresponding reference characters indicate corresponding parts throughout the drawings.

DESCRIPTION OF A PREFERRED EMBODIMENT

Figure 1:
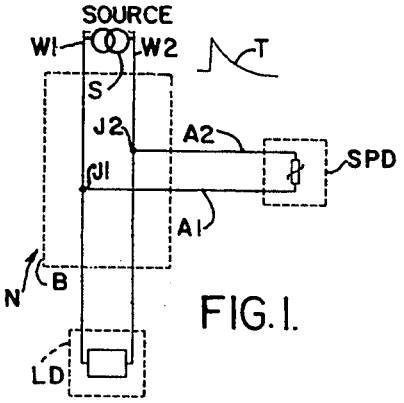
FIG. 1 is a schematic diagram of a typical power distribution network with a SPD installed to protect loads connected to the network from voltage surges.

Referring to the drawings, a power distribution network is indicated generally N in FIG. 1. Electrical voltage from a source S is applied to various loads LD through electrical wires or lines W. Although only two such lines W1 and W2 are shown in FIG. 1, it will be understood that in a poly-phase power distribution network such as a three-phase network, there will be more than two lines supplying power to a three-phase load. It is not unusual for voltage surges or transients T to propagate down the lines and be impressed on a load. As is well-known, if the transients are large, the loads can be severly damaged by the high-voltage levels to which they are subjected. To reduce this possibility, surge protective devices commonly referred to as SPD's are connected across wires W so to be in parallel with the load. Although only one SPD is shown in FIG. 1, it will be understood that in multi-phase networks, there may be an SPD connected in parallel across each phase. In addition, or alternatively, an SPD may be connected between each phase and neutral, between each phase and electrical ground, or between neutral and ground. The SPD is connected across the phase lines typically at a service distribution box B. Connector lines A1 and A2, which represent a coaxial cable of the present invention, are respectively attached to lines W1 and W2 at respective terminals or junctions J1 and J2 within the distribution box.

With a SPD connected in the network, as shown, when a transient T propagates along lines W, it is sensed by the SPD. Each SPD is designed for a predetermined voltage level above which the SPD operates. If the transient voltage exceeds this threshold, the SPD presents a near short-circuit across the lines W until the surge voltage level falls back below the threshold. Downstream loads LD, and especially relatively high impedance loads are protected from the surge voltage by operation of the SPD. Ideally, the SPD presents a perfect short-circuit and diverts all of the current back to the source. Because wires A1 and A2 are less than ideal, the SPD is not subjected to all of the transient voltage. Some of the higher level surge voltage gets through or is "let through" to the loads. As is described hereinafter, it has been found that the cables A used to connect the SPD across the lines are one reason why high levels of surge voltage get through to loads LD.

Referring to FIG. 3, the cables A currently used in the hook-up shown in FIG. 1 are shielded twin type conductors, constructed of THHN wire.

Figure 2:
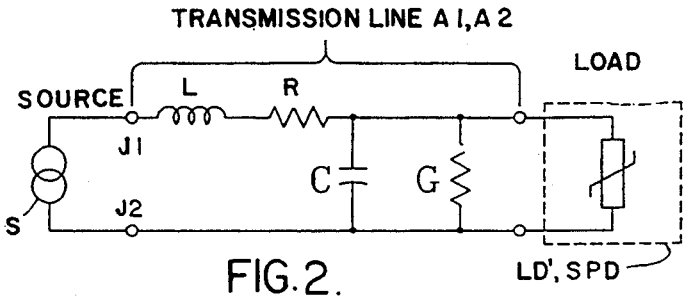
FIG. 2 is a lumped circuit model of a transmission line.

In analyzing the cables A used to interconnect a SPD with feeder wires W, it will first be understood that with respect to these conductors, they run parallel to each other with a dielectric material separating them. Second, it will be understood that their characteristics cannot be treated as lumped characteristics, but must be considered as distributed. Accordingly, they can be considered as a series of small, but finite circuit elements each of which represents some value per given unit length. Referring to FIG. 2, a circuit model of a transmission line A is shown. In the transmission line model, an inductance L and dc resistance R are in series between source S and the load LD'. A capacitance C and conductance G are in parallel with the load. For the model, the following represent the lumped circuit values:

$\zeta = L/l$ = series inductance per unit length, $R = r/l$ = series DC resistance per unit length, $C = c/l$ = parallel capacitance per unit length, and $G = g/l$ = parallel conductance per unit length, where $l$ = cable length.

Of the representative lumped circuit elements, the series connected elements L and R produce a voltage drop and resist current flow. They also increase the overall load impedance. The parallel connected components C and G divert current and decrease the overall load impedance. The values for the inductance and capacitance are a function of transmission line geometry, with capacitance also being dependent upon the dielectric constant of the material separating the conductors A. The value of resistance R is a function of the resistivity and cross-sectional area of the conductor material. I.e., $r = \rho l/A$ where $\rho$ is resistivity of the material used, l is length as noted above, and A is the cross-sectional area of the conductor. The shunt conductance is a function of the conductivity of the insulating material separating the conductors. Using the representation of FIG. 2, is characteristic impedance $Z_c$ of transmission line is given by:

$$Z_c = \sqrt{((R + iwL)/(G + iwC))} ,$$

where i represents the $\sqrt{-1}$, and w is the frequency. Often, to minimize losses, the characteristic impedance of the transmission line is impedance matched with both the voltage source S and load LD'.

In evaluating the operation of a SPD with cables A, the factors to be evaluated are the voltage drop across the inductance $\zeta$ and resistance R, and the currents drawn through capacitance C and conductance G. When a transient T propagates through the network, the voltage drop across the inductance and resistance is expressed as:

$$V_{\zeta+R}(t) = V_{\zeta}(t) + V_R(t), \text{ or}$$

$$V_{\zeta+R}(t) = \zeta l(dI(t)/dt) + Rl(I(t)),$$

where I(t) is total current through the transmission wire. Current flowing through the shunt components C and G is expressed as:

$$I(t) = I_C(t) + I_G(t), \text{ or}$$

$$I(t)=C/(dV_{LOAD}(t)/dt)+GLV_{LOAD}(t)$$

where V(t) is the total voltage impressed on the system and is given by the expression $$V(t)=V_{\zeta+R}(t)+V_{LOAD}(t)$$

The above equations can be combined to produce a second order differential equation for the voltage across the load. This equation is a function of time and is expressed as:

$$d^2/dt^2V_{LOAD}(t)+(R/\zeta)d/dtV_{LOAD}(t)+(1/\zeta C)\text{-}V_{LOAD}(t)=(1/\zeta C)V(t).$$

Referring to the table of FIG. 3, different transmission line geometries are shown. Expressions for the different elements for each particular geometry are listed in the table. The information in the table can be found in *Theory of Guided Electromagnetic Waves*, by R. A. Waldron, Van Nostrand, Reinhold Co., 1970, Chapter III. Some cable geometries are not listed in FIG. 3 because their characteristics are similar to those already listed. Or, the geometry of the cable construction is impractical. These geometries include striplines, triplate lines, and geometries based on placement of cylindrical wires between plates.

With respect to the table of FIG. 3, it will be noted that the real portion of the impedance ($Z_c$) corresponds to the real part of the complex impedance in the equation:

$$Z_c = \sqrt{(R + iwL)/(G + iwC)}\ .$$

When G=O, the expression can be reduced to:

$$Z_c = \sqrt{(L/C)}\ .$$

Figure 8A:
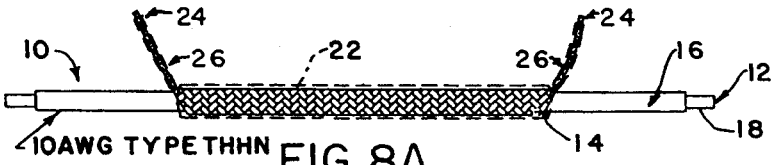
FIGS. 8A and 8B represent different views of one low impedance coaxial cable design of the present invention.
Figure 8C:
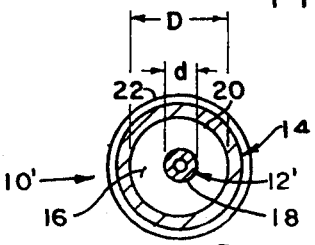
FIG. 8C represents a cross-sectional view of an alternate coaxial cable construction.
Figure 8B:
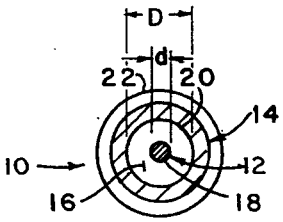

Preferably, a cable 10 of the present invention, which is shown in FIGS. 8A and 8B, is for use in power distribution networks for connecting SPD's in parallel with network conductors. The cable is a coaxial cable having an inner conductor 12 which is a round wire conductor of diameter d. It further has an outer, hollow cylindrical conductor 14, which, as shown in FIG. 8A is a braided wire conductor having an inner diameter D. A ratio of the outer conductor's inner diameter to the diameter of the inner conductor; i.e., D/d, is referred to as the aspect ratio for the coaxial cable. An insulation material 16 is annular in cross-section. The material fills the space between an outer surface 18 of inner conductor 12 and an inner wall 20 of the outer conductor. The coaxial cable also has an outer jacket of insulation material 22.

As is now discussed, the material used to fabricate cable 10 is such that the cable has a DC resistance that minimizes voltage drop to the clamping elements (not shown) within the SPD which react to the sensed transient voltage condition. These clamping elements are typically metal-oxide varistors, or MOV's. Referring to FIG. 4, a characteristic voltage-current curve for a MOV is shown. From this graph, the clamping voltage dependency on surge current will be understood. That is, an MOV will clamp the voltage within a narrow range around 200 V for a current range which covers six orders of magnitude.

Cable 10 also includes minimal series inductance. However, it further has a maximum shunt capacitance to divert surge current from the clamping elements and reduce clamping voltage. These cable 10 features are important because, as discussed above, it is important in protecting loads LD to minimize the "let through" voltage to the loads. This means it is important, in turn, to minimize the voltage drop from the junction points J to the points at which the cable is connected to the SPD, since the SPD will then be the most responsive to transients. Finally, shunt conductance is small for most materials which may be chosen for insulator/dielectric 16. The conductivity of most commonly used dielectrics is on the order of $10^{-14}$ mho/cm. If the cable run for cable 10 is ten feet, for example, and a 10 KV transient pulse propagates down the cable, the total current drawn through the cable, due to conductivity of material 16, is on the order of 30 nA. This current level is insignificant. Accordingly, shunt conductance can be generally disregarded in choosing the appropriate materials for cable 10. With regard to the materials chosen, in addition to their selection for the electrical properties they possess, they are also chosen on the basis of manufacturability, connectability, safety, overall cable 10 size (cross-sectional area, etc.), and safety.

To minimize dc resistance in cable 10, inner conductor 12 is chosen to have as large a diameter d as is practical. This maximizes the cross-sectional area of the conductor. Next, the material from which the conductor is made is selected for its low resistivity. Copper has a resistivity of approximately 1.72 micro-ohms/cm. For silver, this value is 1.59 micro-ohms/cm. In choosing which of these preferable materials to use, the decision is a function of the approximately 7.6% improvement in resistivity using silver versus the price of a coaxial cable 10 made with more expensive silver wire. If SPD protection of loads from transients is very critical, then silver is the material of choice. Otherwise, copper can be used.

It will be appreciated that the inductance and capacitance of cable 10 are functions of the cable geometry. Capacitance is also a function of the dielectric relative permittivity of the insulation material used in the cable. Generally, materials which could be used for insulation 16 have a permittivity which ranges from 1.0–8.0. For use in cable 10, it has been found that the materials which provide the best results have permittivities ranging from 1.5–8.0. Typically, insulation material 16 has a permittivity of approximately 3.0.

The geometry of the currently used THHN cables is a shielded twin geometry. For this construction, inductance is minimized for a minimum (w/r) $\gamma$. Parameter $\gamma$ is minimized for a maximum value of w/2R. This occurs at 2R=2w, when an insulated, twisted twin conductors are tightly wrapped with the shielding for the cable. Thus, $$(w/2R)_{max}=\tfrac{1}{2},\ \text{which implies,}\ \gamma_{min}=3/5.$$

Figure 5:
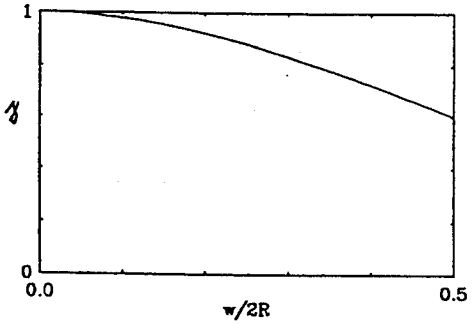
FIG. 5 is a graph depicting shielded-twin geometric factors vs. separation to shield diameter ratio.

Referring to FIG. 5, the dependence between w/2R and $\gamma$ is shown. To get a comparison between the shielded twin geometry of currently used cables, and that of coaxial cable 10, the minimum $\gamma$ value is used. First, the scale sizes between the two types of conductors is made comparable. That is, $$(D/d)_{coax}=(w/2r)_{S-twin}.$$

From this relationship, the ratio of inductance for the respective conductors is expressed as:

$$L_{coax}/L_{S-twin}=ln(D/d)/2ln(6D/5d).$$

Figure 6:
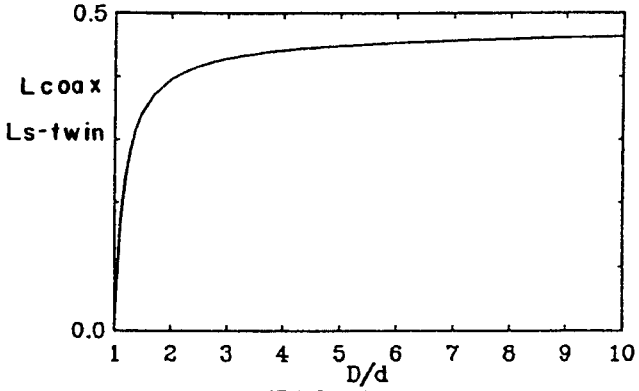
FIG. 6 is a graph depicting the ratio of coaxial inductance to shielded-twin inductance vs. cable aspect ratio.

As D/d approaches plus infinity, the ratio expressed above converges on the ½ value. This is shown in FIG. 6. Further, if an unshielded twin-type geometry is used, the above expression is restated as:

$$L_{coax}/L_{twin}=ln(D/d)/2ln(2D/d)\leqq L_{coax}/L_{S=twin}.$$

Consequently, regardless of which type of twin conductor is used in the hook-up of FIG. 1, the coaxial geometry of cable 10 provides at least a factor of two improvement in the reduction of inductance, for comparable sized conductors.

As noted previously, capacitance in a cable varies inversely with inductance. Therefore, based upon the above formulations, there should be an increase in capacitance in cable 10 over that in a shielded or non-shielded twin conductor. This increase should be by a factor of at least two. The dc resistance for cable 10 should, however, be comparable with that of shielded twin cable conductors now in use, assuming 1) that inner conductor 12 is a similar gage wire to that of either of the two inner conductors of the shielded twin cable, and 2) that an equivalent gage is also used for outer conductor 14.

Having established that coaxial cable 10 provides an improvement of at least two with respect to certain performance parameters with respect to shielded twin cables, the cable's performance is also compared with other type conductors shown in FIG. 3. With respect to a parallel plate cable geometry, the scale size of the two type cables are first made comparable. That is, the aspect ratios for the two types of cable are expressed as:

$$(D/d)=(y/x).$$

The ratio of inductance for the two type cables is then, $$L_{coax}/L_{p.p.}=(1/2\pi)(D/d)ln(D/d)$$

Figure 7:
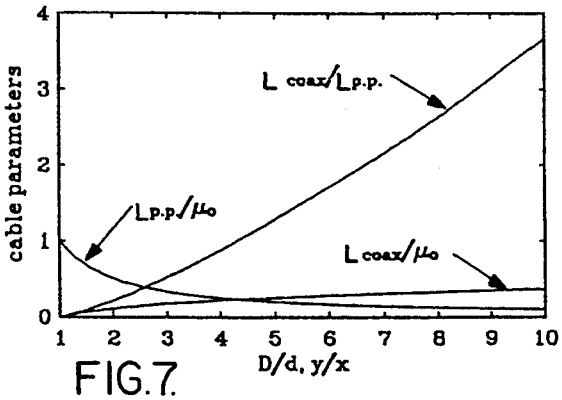
FIG. 7 is a graph depicting parallel plate and coaxial geometry parameters as a function of aspect ratio.

FIG. 7 graphically represents the ratio of cable 10 and parallel plate inductances per unit length. These values have been normalized on the basis of vacuum permittivity. With respect to FIG. 7, it is shown that when D/d is <4.3, the geometry of cable 10 provides better results than the parallel plate geometry. Otherwise, very significant parallel plate aspect ratios are required in the parallel plate geometry to obtain a performance similar to that of cable 10.

Based on the foregoing, the geometry of cable 10 provides better performance characteristics, given normal manufacturing requirements for cables to be used in the network/SPD application than either of the other two cables. That is, for a reasonable aspect ratio (D/d), better low-inductance, high-capacitance performance is available with cable 10. As noted, shunt conductance can generally be disregarded.

For the coaxial cable geometry of cable 10, the inductance L, resistance R, and capacitance C characteristics must also be considered in order to optimize the performance of a MOV in a SPD. Peak performance of a MOV minimizes the clamping voltage. First, it has been found that the preferred aspect ratio of cable 10 is 1.05. This means the diameter d of inner conductor 12 is substantially the same diameter as the inner diameter of outer conductor 14. Or, there is only a thin layer of insulation material 16 separating the inner and outer conductors. For this aspect ratio, and given other practical considerations such as the overall size of cable 10, dielectric voltage hold-off, etc., cable 10 can provide the desired MOV performance for a SPD connected to the network.

With the 1.05 aspect ratio, and a relative permittivity of 3.0, the capacitance of cable 10 is approximately 0.0035 microfarads/meter. ANSI/IEEE C62.41 deals with IEEE Recommended Practices for Surge Voltages in Low-Power AC circuits. A category B3 combination waveform set out in this document has waveform characteristics of 1.2×50 microseconds at 6 kV, and 8×20 microseconds at 3 kA. For this test or specimen waveform, the capacitance of cable 10 diverts over 3.0+ amps. I.e., $$I=(CV)/t=3.15 \text{ amps}.$$

Given a 3 kA short-circuit current, a 3.15 amp, or 0.11% current diversion is insignificant. This can be readily seen by viewing the MOV operating characteristics of FIG. 4. As shown on the V–I curve of this Fig., for the normal operating range of the MOV, where the slope of the curve is approximately zero, a reduction from 3 kA, for example, down to 2, 997A has no significant effect in reducing the clamping voltage of a SPD. If, however, much faster transients than those represented by a category B3 waveform appears, the contribution of the capacitance will become increasingly significant.

The geometry of the cable 10 design further specifies the inductance L. From FIG. 3, the inductance per unit length of cable 10 is:

$$L=(\mu_0/2\pi)ln(D/d)=(\mu_0/2\pi)(1+(\delta/r)).$$

where δ is the thickness of the dielectric material, and r is the radius of inner conductor 12. By minimizing the value of δ/r, the inductance of the cable can be minimized. This is accomplished where, as in cable 10 with its aspect ratio of approximately 1.05, inner conductor 12 has a large diameter d, and material 16 comprises a thin annular layer between the inner and outer conductors. So long as the dielectric layer of material 16 is sufficiently thick to hold off nominal line voltage, it does not have to be especially thick. Further, the inner conductor does not have to be a solid conductor. As shown in FIG. 8C, coaxial cable 10' includes an inner conductor 12' which is a hollow, cylindrical conductor. The trade-off is that a hollow inner conductor has less cross-sectional area than a solid one. Accordingly, the dc resistance of conductor 12' is higher than that of conductor 12 for a same diameter d conductor. Further, because the hollow core inner conductor 12' uses less copper or silver, a cable using this inner conductor is relatively less expensive.

In designing cable 10, one factor to be considered for commercial use of the cable is obtaining Underwriter's Laboratory (UL) acceptance. A fabrication of a test cable 10 is shown in FIG. 8A in which a #10 AWG type THHN wire is covered with a #10 AWG tinned copper braiding to form the outer conductor of the coaxial cable. Braid pig-tails 24 are formed at each end of the cable are covered with a length of shrink tubing 26. For purposes of determining a trend in cable 10 behavior, five cables were constructed similar to that shown in FIG. 8A. One cable each was constructed of #14, #10, #6, #2, and #3/0 AWG. The thickness of the dielectric material (δ) was kept constant at 0.025" (0.635 mm); while, the minor radius r ranged from 0.225" (5.72 mm) to 0.032" (0.81 mm). The cross-sectional area of the center conductor 12 varied proportionately with $r^2$. The variance in radius also effected the DC resistance of the conductor.

Figures 10, 11:
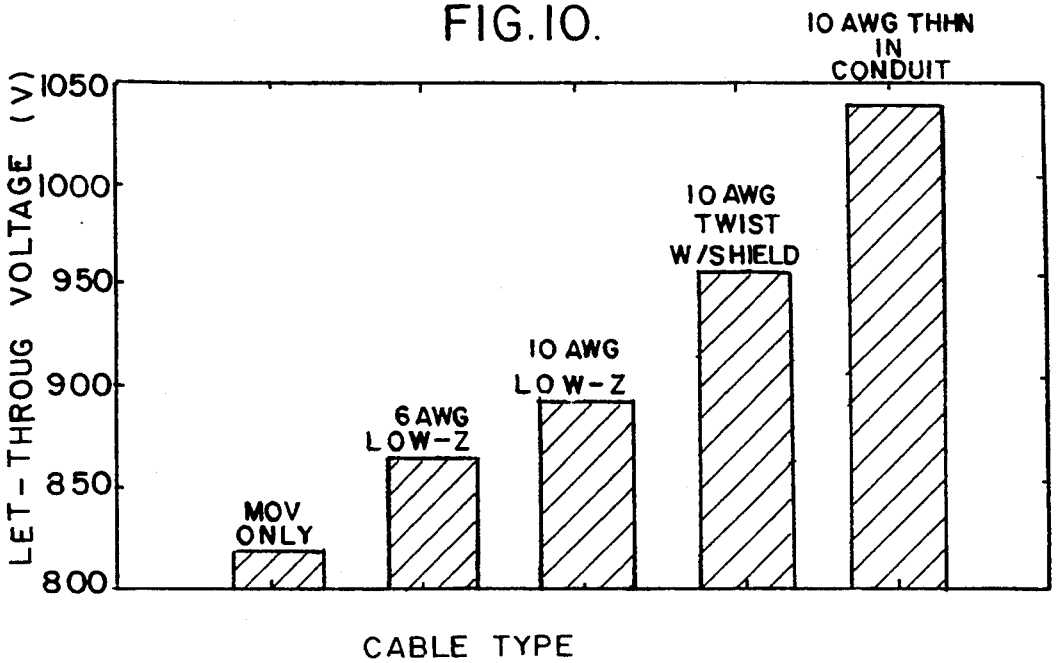
FIG. 10 is a table of coaxial cable parameters for performance characterization for the cables of this invention; and, FIG. 11 is a graph comparing SPD clamping voltages for various cable geometries.

FIG. 10 presents a table listing each of the five cables 10 and the cable parameters of each. Lines 1–8 of FIG. 10 list the respective parameters discussed above for cable geometry and materials including the various resistance, inductance, and capacitance values. Each cable was connected to a MOV. The MOV and cable were mounted in a common fixture that was used throughout the tests. Each cable was pulsed with a 1,500 V category C transient. This transient's characteristics are 1.2×50 microseconds at 6 kV, and 8×20 microseconds at 10 kA. Each are maximum figures. Further, for each test cable, five transient waveforms were generated and propagated through the cable to the MOV. The clamping voltage and current results were averaged and the resulting deviation is shown at lines 13 and 15 of FIG. 10 for each cable. In addition to these tests, the MOV was directly connected to the pulser unit (not shown) used to generate the transient waveforms. Transient waveforms generated by the pulser unit were then directly applied to the MOV as a voltage surge. The difference between the clamping voltages, with and without a test cable connected to the MOV, are shown at line 16 of FIG. 10. The peak current for each cable is shown at line 14 of the Fig. The variation in peak current is approximately 7% which is within an acceptable range for a valid experiment.

For each test cable, the voltage drops due to cable inductance and dc resistance are calculated in accordance with the respective formulas previously derived. The dc resistivity of the cable was directly measured. Line 9 of FIG. 10 indicates the values for outer conductor 14 and line 10 for inner conductor 12.

Figure 9:
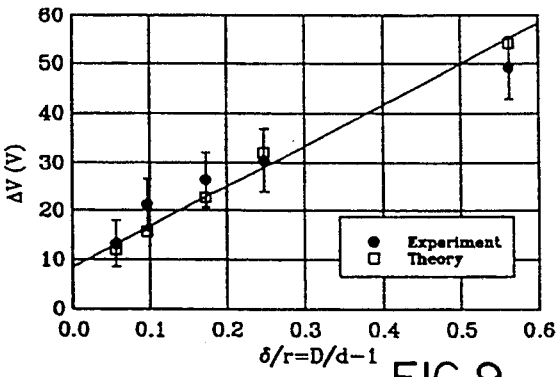
FIG. 9 is a graph comparing experimental and theoretical clamping voltages as a function of an aspect ratio of a cable.

FIG. 9 represents a comparison between theoretical and actual experimental additional clamping voltage (over MOV only clamping voltage) for the various cables. The upper and lower bars represent the upper and lower limits for each cable based upon the experimental results. In each instance it is seen that the theoretical calculations and actual results are within an acceptable range of each other. Based upon this test information, it is evident that the two critical design parameters of a cable 10 are 1) the ratio of thickness of the dielectric material 16 used to the radius of center or inner conductor 12, and 2) the cross-sectional area of the conductors. The first of these determines inductance, and the second dc resistance.

In addition to the above described test, a second series of tests were performed testing the performance of the geometry of coaxial cable 10 with that of other cable geometries. Two coaxial cables were used in the test, one a #6 AWG cable, and the other a #10 AWG cable. In addition to the cables 10, the other geometries included a twisted quad cable with an over braid, and a pair of THHN wires in a conduit. Each cable was identical in length, i.e., 9.25 ft. (2.82 m). One end of each cable was connected to a pulser unit similar to that used in the previous tests, and the other end to a MOV. Again, a 1,500 V category C transient was propagated down each cable and clamping voltages and currents were measured. Again as before, the MOV was tested without a cable connected to it.

Referring to FIG. 11, the "let-through" voltage for each test cable, in addition to the MOV itself, are shown. The MOV, by itself, measures slightly over 800 V. The THHN cable, which is shown on the far right of the Fig. has a "let-through" voltage which is some 220 V higher than the MOV. Next to the THHN cable, the twisted quad with over-braid cable is shown to permit a "let-through" voltage over 140 V higher than the MOV by itself. With respect to the two sizes of coaxial cables used, the #10 AWG cable allows less than 75 V over the MOV by itself. This is threefold improvement over the conventional THHN cable. Finally, the #6 AWG cable allows less than 50 V. over the MOV by itself. This represents a 4.6 times improvement over the conventional cable's performance.

What has been described is a cable 10 for use in power distribution networks N for connecting SPD's in parallel with network conductors W. This allows the SPD to protect loads LD connected to the network from high voltages surges and transients. The cable is a low impedance coaxial cable capable of use with any type SPD and whose use produces a minimal voltage drop so the SPD is subjected to substantially all the transient voltage. This, in turn, reduces or eliminates the amount of voltage "let through" to loads downstream of the SPD. Low impedance of the cable is based on an optimal cable geometry, cable dimensioning, and the material used in making the cable. In this regard, the cable of the invention has a minimized series inductance and dc resistance. The cable has parallel conductors separated by an insulator which produces a negligible shunt conductance between the conductors. The cable has a compact form with an aspect ratio of only 1.05. It will be understood, however, that as shown in FIG. 10, cables having an aspect ratio D/d ranging from approximately 1.05 to approximately 1.56 fall within a range of cable aspect ratios contemplated by the invention. Use of the cable allows for a greatly reduced SPD clamping voltage rating. The cable is safe in use, and is easy to make.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A cable for use in power distribution networks for connecting a surge protective device (SPD) in parallel with feeder lines of the network to sense voltage surges on the feeder lines and clamp the voltages to a level at which loads connected downstream are protected from excessive levels of voltage comprising:

conductor means including an inner conductor and an outer conductor, said inner and outer conductors being coaxial with each other with said inner conductor being disposed within said outer conductor, and said inner and outer conductors being of a low resistivity material with the aspect ratio of said inner and outer conductors being approximately 1.05–1.56;

dielectric means disposed between said inner and outer conductors, said dielectric means including a dielectric material having a predetermined permittivity; and, cover means fitting over said outer conductor, said cover means being an electrically insulating cover, the aspect ratio of said conductors, and the permittivity of said dielectric means substantially reducing the "let through" voltage to which the loads are subjected in the event of a voltage surge as compared to the "let through" voltage to which they are subjected when conventional cables are used to connect the SPD.

2. The cable of claim 1 wherein said inner and outer conductors are made of copper.

3. The cable of claim 1 wherein said inner and outer conductors are made of silver.

4. The cable of claim 1 wherein said inner conductor is a hollow, cylindrical conductor.

5. The cable of claim 1 wherein the permittivity of the dielectric material is in the range of 1.5–8.0.

6. The cable of claim 5 wherein the permittivity of the dielectric material is approximately 3.0.

7. A coaxial cable for use in power distribution networks for connecting a surge protective device (SPD) in parallel with feeder lines of the network for the SPD to sense voltage surges on the feeder lines and clamp the voltages to a level at which loads connected downstream of the SPD are protected from excessive levels of voltage comprising: an inner conductor and an outer conductor with a dielectric material between the conductors, said inner conductor being a round conductor and said outer conductor forming a hollow, cylindrical conductor in which said inner conductor and insulation material fit, the ratio of the inner diameter of said outer conductor to the diameter of the inner conductor being approximately 1.05–1.56 whereby the diameter of the inner conductor is nearly as large as the inner diameter of said outer conductor, a relatively large diameter of said inner conductor serving to minimize the DC resistance of the cable, and the dielectric material having a permittivity in the range of 1.5–8.0.

8. The coaxial cable of claim 7 wherein the inner and outer conductors are made of copper.

9. The coaxial cable of claim 7 wherein the inner and outer conductors are made of silver.

10. The cable of claim 7 wherein the permittivity of the insulation material is approximately 3.0.

11. The cable of claim 7 wherein the inner conductor is also a hollow, cylindrical conductor.

12. The cable of claim 7 wherein the outer conductor is a braided wire conductor.

13. In a power distribution system in which a surge protective device (SPD) is connected in parallel with power distribution lines to protect loads to which electrical power is distributed to protect the loads from high-voltage transients, the improvement comprising a coaxial cable by which the SPD is connected across the lines, said coaxial cable being characterized as a low impedance cable in which the series inductance and resistance are controlled by an appropriate selection of materials from which the coaxial cable is fabricated to provide its low impedance characteristics, the coaxial cable including an inner conductor and an outer conductor in which the inner conductor is disposed, and a dielectric material separating the two conductors, the ratio of the inner diameter of said outer conductor to the diameter of the inner conductor being approximately 1.05–1.56 whereby the diameter of the inner conductor is relatively large whereby the cross-section of the inner diameter is such as to minimize the cable resistance, and the dielectric material has a permittivity in the range of 1.5–8.0 which minimizes the series inductance of the cable.

14. The cable of claim 13 wherein the outer conductor is a hollow, cylindrical conductor and the inner conductor is a solid wire conductor.

15. The cable of claim 13 wherein both the outer and inner conductors are hollow, cylindrical conductors.

16. The cable of claim 13 wherein the outer conductor is a braided wire conductor.

* * * * *